US005827958A

United States Patent [19]

Sigler

[11] Patent Number: 5,827,958

[45] Date of Patent: Oct. 27, 1998

[54] PASSIVE VELOCITY DATA SYSTEM

[75] Inventor: John W. Sigler, La Mirada, Calif.

[73] Assignee: Primex Technologies, Inc., Downey, Calif.

[21] Appl. No.: 583,374

[22] Filed: Jan. 5, 1996

[51] Int. Cl.[6] ..... G01L 5/14; F42C 11/06

[52] U.S. Cl. ..... 73/167; 89/6.5; 102/215

[58] Field of Search ..... 73/167; 89/6.5; 102/215

[56] References Cited

U.S. PATENT DOCUMENTS

| | | | |
|---|---|---|---|
| 3,126,768 | 3/1964 | Mason | 73/167 |
| 3,215,932 | 11/1965 | Sims et al. | 73/167 X |
| 3,659,201 | 4/1972 | Vogelsand | 73/167 X |
| 3,787,770 | 1/1974 | Cote et al. | 73/167 X |
| 3,809,964 | 5/1974 | Ceyrat | 102/28 R |
| 3,824,463 | 7/1974 | Oehler | 73/167 X |
| 4,030,097 | 6/1977 | Gedeon | 73/167 X |
| 4,080,869 | 3/1978 | Karayannis et al. | 89/6.5 |
| 4,129,829 | 12/1978 | McLellan | 324/178 |
| 4,207,796 | 6/1980 | Warnock . | |
| 4,228,397 | 10/1980 | Schmidt | 324/179 |
| 4,283,989 | 8/1981 | Toulios et al. | 89/6.5 |
| 4,342,961 | 8/1982 | Zimmermann et al. | 324/179 |
| 4,350,096 | 9/1982 | Cannavo et al. | 102/209 |
| 4,377,113 | 3/1983 | Florence | 102/209 |
| 4,452,342 | 6/1984 | Schmidt et al. | 324/207 |
| 4,483,190 | 11/1984 | Cornett | 73/167 |
| 4,486,710 | 12/1984 | Schmidt | 324/179 |
| 4,524,323 | 6/1985 | Schmidt | 324/179 |
| 4,649,796 | 3/1987 | Schmidt | 89/6.5 |
| 4,653,211 | 3/1987 | Brede et al. . | |
| 4,664,013 | 5/1987 | Wegner et al. | 89/6.5 |
| 4,677,376 | 6/1987 | Ettel et al. | 324/179 |
| 4,862,785 | 9/1989 | Ettel et al. | 89/6.5 |
| 4,955,279 | 9/1990 | Nahrwold | 89/6.5 |
| 5,088,381 | 2/1992 | Lamarque et al. | 89/6.5 X |
| 5,101,728 | 4/1992 | Frink | 102/209 |
| 5,220,126 | 6/1993 | Borgwarth et al. . | |
| 5,235,129 | 8/1993 | Corney . | |
| 5,265,539 | 11/1993 | Kurschner et al. | 102/206 |

FOREIGN PATENT DOCUMENTS

| | | | |
|---|---|---|---|
| 3309147 | 9/1984 | Germany | 89/6.5 |
| 34 43 534 C1 | 3/1995 | Germany . | |

*Primary Examiner*—Thomas B. Will
*Assistant Examiner*—Willie Morris Worth
*Attorney, Agent, or Firm*—Gregory S. Rosenblatt; Wiggin & Dana

[57] ABSTRACT

There is provided a velocity measuring system contained on-board a projectile. The velocity is determined by a microprocessor on-board said projectile that bases the computation on a measurement of the time required for the projectile to pass two fixed points along the gun barrel. The fixed points may be passive signal sources that do not require an external power supply. A high degree of velocity accuracy is achieved because the microprocessor calculation need not be completed during the projectile's traversal of the gun barrel.

17 Claims, 3 Drawing Sheets

PASSIVE VELOCITY DATA SYSTEM

BACKGROUND OF THE INVENTION

1. Field of the Invention

This invention relates to a projectile that is fired from a gun or a launcher. More particularly, the invention provides a passive system by which the velocity of the projectile is accurately determined upon exit from the gun muzzle or launcher. The velocity data is then utilized for internal computations within the projectile for, but not limited to, time of flight, burst point prediction and sensor initiation.

2. Description of Related Art

Semi-smart munitions have the capability to make a logical decision regarding an intended function. The logical decision is usually based on information provided to the munition at launch, as opposed to a smart projectile that makes a logical decision based on information received in flight.

The semi-smart munition may be any type of munition such as a projectile, bomb or rocket. While the specification is described in terms of projectiles, a subclass of munition that is launched from a gun barrel by a propelling force that acts only while the projectile is within the gun barrel, the invention is intended to encompass all types of munitions and related devices.

In the field of semi-smart projectiles, a major source of error in determining the terminal position of the projectile or munition is the error in accurately knowing the projectile's initial velocity. Even with the best propellant system to launch a projectile, unacceptable variations in launch velocity occur due to environmental conditions or the slightest variability in propellant grain size. With the growing need for smart fuzing, to be able to function at a given range or set of conditions, accurate initial velocity data must be communicated to the fuze within the moving projectile or munition. The initial velocity data can then be used to relate time of flight to the distance traveled.

Many systems have been disclosed to determine projectile velocity, but few of these systems have the capacity to transmit the velocity data to the fuze. U.S. Pat. No. 4,677,376 to Ettel et al. discloses front and rear induction coils circumscribing the barrel of a weapon. A fired projectile first passes through the rear coil generating a first pulse. Subsequently, the projectile passes through the front coil generating a second pulse. Knowing the distance between the two coils and the time between the two pulses, it is possible to determine the projectile velocity.

It is also known to measure the velocity of a projectile moving away from a weapon by tracking the projectile by radar and determining the frequency shift due to the Doppler effect. This technique is disclosed in U.S. Pat. No. 4,283,989 to Toulios et al.

U.S. Pat. No. 4,649,796 to Schmidt discloses information such as a fuze timing delay communicated to a projectile by a transmitter coil mounted on the end of a gun barrel and oscillating at a controlled frequency. The projectile has an internal coil that detects the frequency of oscillation and utilizes this information to set a specific time delay.

The primary purpose of a time delay fuze is to have the projectile function at a given distance from the gun. Using time of flight to gage range can be an accurate method only if the initial velocity is accurately known. The velocity of a projectile fired from a gun is highly variable and can create large errors for semi-smart projectiles needing accurate range versus time of flight data. Many factors influence the variability of projectile velocity including slight variations in the propellant, changes in temperature or humidity, gun barrel temperature and the size and weight variation of the projectile itself.

It is known that systems exist that measure the velocity of a projectile by utilizing a pair of spaced induction coils that detect the passage of the projectile and transmit spaced pulses to a ballistic computer on the weapon system. The ballistic computer calculates the projectile velocity and transmits a corrected time delay to the projectile fuze through a third induction coil to adjust the time delay based on the computed launch velocity.

The prior art systems have drawbacks. Many of the prior art systems only measure the launch velocity of the projectile and do not communicate this information to the fuze. The systems that do address communication of corrected velocity data to the fuze are physically large systems with multiple coils mounted on the barrel requiring external power to drive the system. These systems are required to perform the measuring, computing and transmitting functions in a limited time interval defined by the distance from the first coil to the gun barrel exit and the projectile velocity. The limited time interval places restrictions on the maximum velocity of a projectile the system can handle and the amount of signal processing performed in the ballistic computer. These systems are useless if the projectile is beyond communication range by the time the corrected velocity data is ready for transmission to the fuze.

SUMMARY OF THE INVENTION

Accordingly, it is an object of the invention to provide a system that determines the velocity of a projectile and arms a fuze with a proper delay. It is a feature of the invention, that in one embodiment, passive signal sources are accurately placed along the gun barrel and a receptor that accurately detects passage of the signal sources is placed on-board the projectile. Suitable combinations of signal source and receptor include: (1) magnetic sources and an induction coil receptor; and (2) metallic sources and a magnetometer receptor.

The projectile fuzing system then, internally: (1) computes the time delay between passage of the signal sources by the projectile; (2) via an on-board microprocessor computes the projectile's launch velocity; and (3) updates the time delay solution to the fuze.

Advantageously, the system of the invention eliminates the need for elaborate sensing coils and transmitting coils on the weapon. Another advantage is the elimination of the need for a power source on the weapon, a sizable advantage for portable systems where weight is important. Still another advantage is that since the signal processing is performed on-board the projectile, the processing does not have to take place immediately at the muzzle exit. The microprocessor has a relatively large time period, 10 to 1000 times that of the prior art systems, to determine the launch velocity, compute a corrected time delay and communicate the delay to the fuze.

In accordance with the invention, there is provided a system for determining the velocity of a projectile. This system includes a gun barrel that expels the projectile. At least one passive signal source supported by the gun barrel communicates with a receptor on-board the projectile. A microprocessor on-board the projectile is in electrical communication with the detector. The microprocessor is programmed to compute the velocity of the projectile.

The above stated objects, features and advantages will become more apparent from the specification and drawings that follow.

IN THE DRAWINGS

Figure 4:
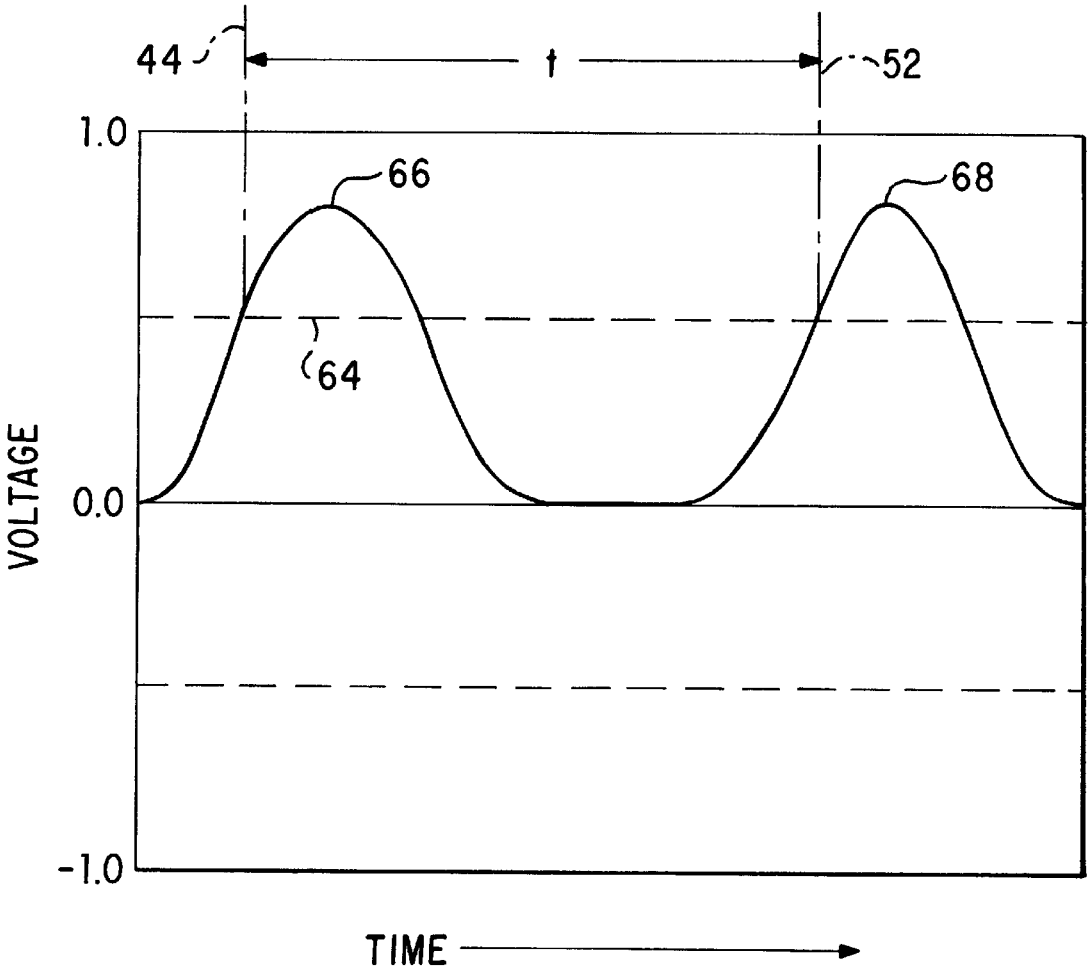

FIG. 4 graphically illustrates one embodiment of the information provided to an explosive projectile in accordance with the invention.

Figure 5:
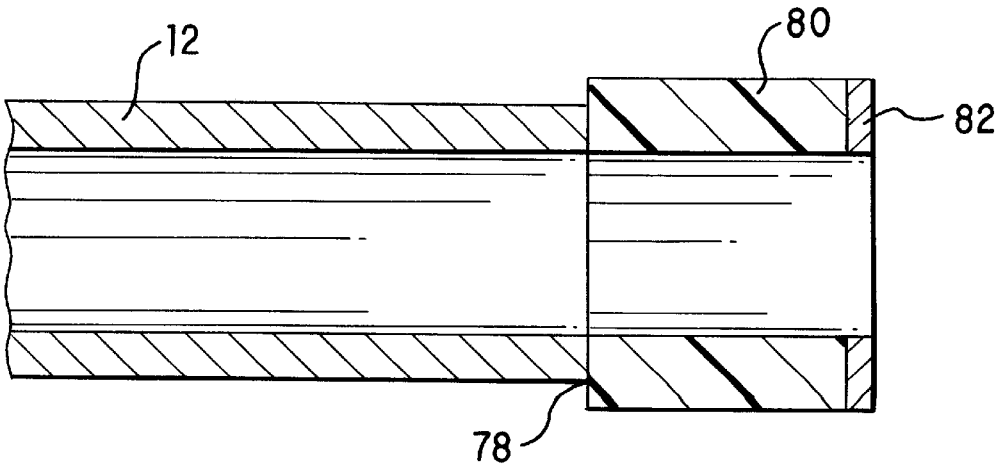

FIG. 5 illustrates in cross-sectional representation a velocity determination system in accordance with an alternative embodiment of the invention.

DETAILED DESCRIPTION

Figure 1:
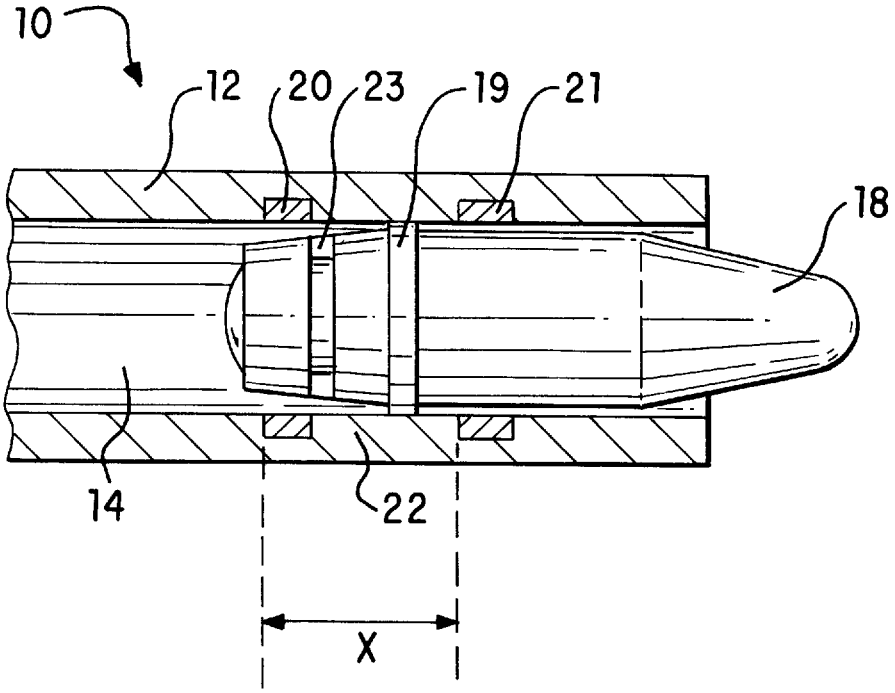
FIG. 1 illustrates in cross-sectional representation a velocity determination system in accordance with a first embodiment of the invention.

FIG. 1 illustrates in cross-sectional representation a portion of a weapon 10 incorporating a velocity determination system in accordance with a first embodiment of the invention. The illustrated portion 10 represents the final section of travel of any size gun barrel 12 or launcher tube. "Gun barrel" as used herein, also incorporates launcher tubes and related devices.

The gun barrel 12 includes a centrally disposed bore 14 of a diameter effective to guide a projectile 18 using a rotating band 19 or obturator to provide guidance and a pressure seal.

The gun barrel 12 is formed from any material capable of providing support and guidance for the projectile 18 and to contain the propelling gases that drive the projectile. Materials for the barrel 12 range from high strength alloy steels, such as AISI/SAE 4340, for high pressure gun systems to lightweight composites such as a graphite filled epoxy for low pressure launcher systems.

AISI/SAE (American Iron and Steel Institute/Society of Automotive Engineers) 4340 is a medium carbon, low-alloy steel having the nominal composition, by weight, of 0.38%–0.43% carbon, 0.60%–0.80% manganese, 0.20%–0.35% silicon, 0.70%–0.90% chromium, 1.65%–2.0% nickel, 0.20%–0.30% molybdenum and the balance iron.

Affixed to the bore 14 adjacent to the exit end of the barrel is at least one signal source. Preferably, there are a first signal source 20 and a second signal source 21, both embedded in a non-signal source material 22.

In one embodiment, the signal sources 20, 21 are permanent magnets and the non-signal source material 22 is a non-magnetic material, such as aluminum alloy 7075 (aluminum alloy 7075 has the nominal composition, by weight, of 1.2%–2.0% copper, 2.1%–2.9% magnesium, 0.18%–0.28% chromium, 5.1%–6.1% zinc and the balance aluminum).

Alternatively, the non-signal source material may constitute a portion of the gun barrel 12. A primary requirement of the non-signal source material is that it provide a clear separation between the first signal source 20 and the second signal source 21. The non-signal source material insures that when the projectile 18 passes the two signal sources 20,21 a receptor 23 on-board the projectile 18 receives two distinct signals.

In accordance with an alternative embodiment of the invention, described in more detail below, the signal sources 20,21 are metallic, such as AISI/SAE 1040 steel that has the nominal composition, by weight, of 0.36%–0.44% carbon, 0.60–0.90% manganese and the balance iron. The non-signal source material 22 is a non-metallic material such as an epoxy-graphite composite.

In all embodiments of the invention, the first signal source 20 may constitute the primary material of the gun barrel 12 with the non-signal material 22 separating the second signal source 21 from the gun barrel 12.

The embodied invention addresses the use of two passive signal sources 20,21, separated by a known fixed distance, "X", to provide a unique timing signal to the projectile 18 for the purpose of having the projectile 18 accurately compute its own gun barrel 12 exit velocity. The projectile 18 contains a receptor 23 that identifies passage of the projectile 18 past both the first 20 and the second 21 signal sources. In one embodiment, the signal sources are magnetic and the receptor is an induction coil or similar device that reacts to passage through a magnetic field. In an alternative embodiment, the signal sources are metallic and the receptor 23 is a magnetometer.

When the signal source is a permanent magnet, suitable materials for the permanent magnet include ferrous materials and rare earth based magnets. Typically, these permanent magnets will have a strength of between 500 Gaus and 5000 Gaus.

Preferably, there are at least two signal sources 20,21 separated by a precisely known distance, "X". While the value of "X" is arbitrary, and typically on the order of from about 2 inches to about 20 inches, the precision in determining X is critical. The time for the projectile 18 to traverse X is utilized in velocity calculations. Since the projectile 18 typically has a muzzle exit velocity of between 500 feet per second and 5000 feet per second, the precision in measuring X should be at least ±0.01 inch, preferably ±0.005 inch and most preferably ±0.001 inch.

Figure 2:
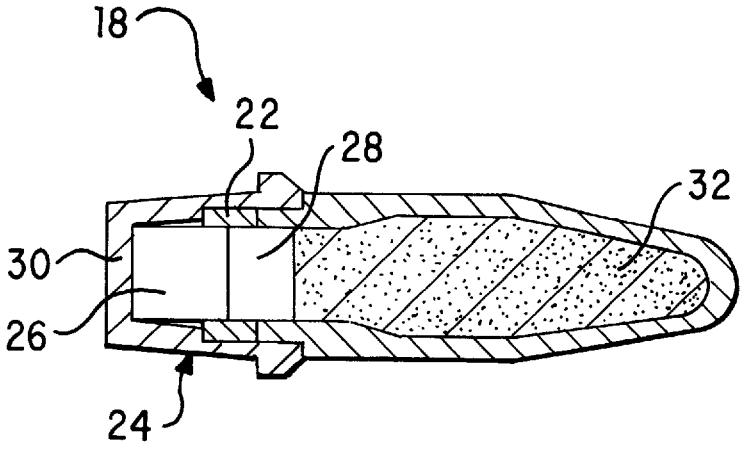
FIG. 2 shows in cross-sectional representation a fuze assembly in accordance with an embodiment of the invention.

As illustrated in FIG. 2, the projectile 18 contains the receptor 23 housed either within or around the projectile body 30 and a microprocessor based electronic module 26 housed within the projectile body 30. Preferably, the microprocessor 26, and optionally also the receptor 23, is housed within a rearward portion of the projectile 18 as a portion of the fuze assembly 24.

One exemplary projectile 18 is of the explosive type and contains a safe and arm device 28 and an explosive payload 32. For the embodiment wherein the signal sources 20,21 are permanent magnets and the receptor an induction coil, the receptor 23 is housed within a non-ferrous portion of the projectile body 30, or alternatively, is wound about the outside of the projectile housing.

The induction coil 23 is comprised of multiple revolutions of an electrically conductive wire. The wire gage and the number of revolutions are dependent on the strength of the signal sources 20,21 and sensitivity of the microprocessor 26. One suitable induction coil has 36 concentric loops of 40 gauge wire circumscribing the longitudinal axis of the projectile 18.

The microprocessor 26 contains, at a minimum, a timing circuit used to measure the time differential between passage of the receptor 23 by the signal sources 20,21 and a logic circuit that starts and stops the timing circuit as a function of the voltage signal induced by the induction coil 23 by a magnetic field emanating from the signal sources 20,21.

The safe and arm device 28 may be any conventional safe and arm device and, typically includes a detonator as part of an open electrical circuit. A metallic wire is mechanically snapped into place if the acceleration and spin of the explosive projectile is within specified ranges. The metal wire completes an electric circuit arming the explosive projectile. A signal from the microprocessor 26 provides the electric current necessary to activate the detonator causing the explosive projectile 18 to burst.

Figure 3:
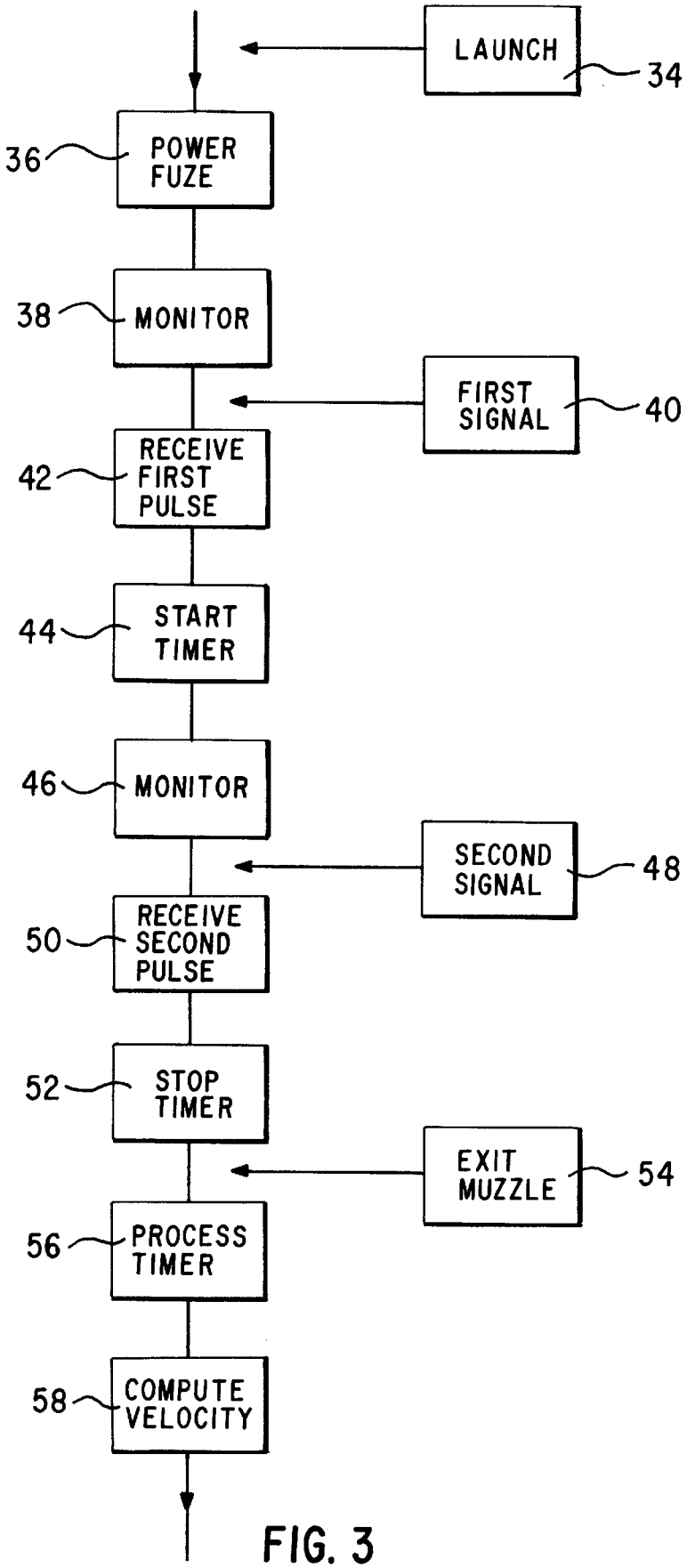
FIG. 3 is a schematic diagram of the programming of an on-board microprocessor.

FIG. 3 illustrates in block diagram an exemplary series of programming steps provided to the microprocessor, as well as the integration of those programming steps with external events.

The first external events are, in either order, the launch 34 of the projectile 18 and the powering up of the fuze 36. The first events are completed by any suitable means. For example, launching of the projectile 18 may be through conventional propellants, as typified by a rifle or canon. More exotic means such as rocket propulsion may also be employed. The only requirement on the launch means is that a velocity effective to drive the projectile past the signal sources and from the muzzle of the weapon is achieved.

Powering of the fuze 36 may be accomplished by a battery on-board the projectile, by an inductive power transfer coupled with capacitive storage or by any other suitable means. The primary requirement of the power up step 36 is that the microprocessor and the receptor are functioning when the projectile passes the signal sources.

After launch 34 and powering of the fuze 36, the fuze with the microprocessor begins to monitor 38 the receptor on-board the projectile. Upon passing the first signal source 40, the microprocessor receives a first signal 42 from the receptor. When the receptor is an induction coil and the signal sources magnets, the first signal is a voltage spike 42. Upon sensing the receptor signal, the microprocessor starts a timer 44 and then returns to monitoring 46 the receptor for a second signal.

Upon passing the second signal source 48, the microprocessor receives a second signal 50 from the receptor and stops 52 the timer. Either concurrent with passing the second signal source 48 or at some time interval later, the projectile exits 54 the muzzle of the weapon. The microprocessor then utilizes the timing data, and being programmed with the signal source spacing, "X", computes 58 the projectile velocity.

FIG. 4 shows a typical signal pattern that the microprocessor receives for the receptor. A variety of methods can be utilized for the microprocessor to process the signal. The method illustrated in FIG. 4 includes triggering the timer start 44 and timer stop 52 as functions of exceeding a specified threshold voltage level 64. This approach yields a time difference, "t" between start and stop.

Alternatively, processing of the signal may be to determine the signal peaks, 66, 68 and taking the time differential between these points.

The microprocessor, having been programmed with the distance, "X", and with the addition of the time differential, "t", computes the actual exit velocity of the projectile from the gun barrel.

Typically, "X" is from 2 inches to 20 inches and the projectile velocity on the order of 500 feet per second to 5000 feet per second. Passage of the signal sources occurs in a few milliseconds (typically 1–10 milliseconds). Since the timing information is obtained and stored on board the projectile, the microprocessor has on the order of 10 to 1000 times the passage time to process the time data and to compute the actual exit velocity. The microprocessor can utilize the exit velocity to predict or update time of flight data, or to perform to a higher degree of accuracy any function of the projectile requiring knowledge of the actual gun barrel exit velocity, such as fuze timing delay.

FIG. 5 illustrates an alternative embodiment of the invention. In FIG. 5, the gun barrel 12 is formed from a metallic material such as AISI/SAE 4340 steel. In this embodiment, the gun barrel is the first signal source. Attached to the exit end 78 of the gun barrel 12 is a non-metallic muzzle 80 formed from a suitable material such as an epoxy/graphite composite. The end of the non-metallic muzzle 80 opposite the exit end 78 is circumscribed by a metallic ring 82, such as AISI/SAE 4340 steel, that is the second signal source.

The non-metallic muzzle 80 is the non-signal material to provide clear separation between the signal sources 78,82. The receptor on-board a projectile is a magnetometer that is triggered by the presence, or absence, or a metallic material alongside the projectile.

While the invention has been described as containing two signal sources within the gun barrel, additional signal sources could be added to obtain a velocity profile with time. While the velocity profile is useful, it is not necessary to the basic objective of the invention, that is muzzle exit velocity measurement.

While the signal sources have been described as ring shape, they may be of any desired shape such as box shaped magnets embedded in the wall of the gun barrel or annular rings through which the projectile passes. Likewise, while the projectile fuze has been described as having a single receptor, multiple receptors are within the scope of the invention.

It is apparent that there has been provided in accordance with this invention a passive velocity measuring system that fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A system for determining the velocity of a projectile, comprising:

a gun barrel that expels said projectile;

at least a first signal source and a second signal source both supported by said gun barrel with a non-signal source material disposed therebetween;

at least one receptor on-board said projectile that detects passage of said at least first and second signal sources; and a microprocessor on-board said projectile in electrical communication with said receptor, said microprocessor containing a timing circuit and a logic circuit and having been programmed to compute the velocity of said projectile.

2. The system of claim 1 wherein the distance between the first signal source and the second signal source is from about 2 inches to about 20 inches.

3. The system of claim 1 wherein said first signal source and said second signal source are both magnets.

4. The system of claim 3 wherein said receptor is an induction coil.

5. The system of claim 4 wherein said non-signal source is a portion of said gun barrel.

6. The system of claim 4 wherein said non-signal source is an aluminum alloy.

7. The system of claim 1 wherein said gun barrel is said first signal source, a muzzle formed from said non-signal source material is affixed to an exit end of said gun barrel and said second source is supported by said muzzle in spaced relationship to said exit end.

8. The system of claim 7 wherein said gun barrel and said second signal source are formed from a metal and said muzzle is non-metallic.

9. The system of claim 7 wherein said gun barrel and said second signal source are both steel.

10. The system of claim 11 wherein said receptor is a magnetometer.

11. A sub-assembly on-board a projectile that is expelled from a gun barrel, comprising:

a receptor that detects the presence of multiple signal sources supported on said gun barrel and transmits a plurality of signals to a microprocessor housed within said projectile;

said microprocessor programmed with the distance between said plurality of signal sources and effective to calculate the expulsion velocity of said projectile from a time delay between said plurality of signals and said programmed distance.

12. The sub-assembly of claim 11 wherein said microprocessor has a timing circuit and a logic circuit.

13. The sub-assembly of claim 12 wherein said receptor is selected from the group consisting of induction coils and magnetometers.

14. The sub-assembly of claim 13 further including an on-board power supply effective to operate said sub-assembly.

15. The sub-assembly of claim 14 wherein said on-board power supply is selected from the group consisting of batteries and inductive power transfer coupled to capacitive storage.

16. A method for on-board computation of the velocity of a projectile, comprising the steps of:

(a) launching said projectile in a gun barrel at an unknown velocity;

(b) causing said projectile to pass a first signal source that is supported by said barrel and transmitting a first signal to a microprocessor on-board said projectile when a receptor on the projectile detects the first signal source;

(c) causing said projectile to pass a second signal source supported by said gun barrel and spaced a known distance from said first signal source and transmitting a second signal to said microprocessor when said receptor detects the second signal source; and (d) calculating said unknown velocity utilizing said microprocesssor on-board said projectile from a time interval between said first signal and said second signal and said known distance.

17. The method of claim 16 wherein following said calculating step, a time delay of a fuze on-board said projectile is updated.

* * * * *